US006374470B1

(12) United States Patent
Goineau

(10) Patent No.: US 6,374,470 B1
(45) Date of Patent: Apr. 23, 2002

(54) FACE PLATE FOR SPUN-LIKE TEXTURED YARN

(75) Inventor: Andre' M. Goineau, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 36 days.

(21) Appl. No.: 09/680,872

(22) Filed: Oct. 6, 2000

(51) Int. Cl.[7] ..... D02J 11/00

(52) U.S. Cl. ..... 28/220; 28/246; 28/258; 28/271

(58) Field of Search ..... 28/220, 219, 240, 28/245, 246, 247, 258, 271, 274; 57/3, 6, 351, 908

(56) References Cited

U.S. PATENT DOCUMENTS

| | | | | | |
|---|---|---|---|---|---|
| 2,276,208 | A | * | 3/1942 | Kline | 57/2 |
| 4,309,801 | A | * | 1/1982 | Feffer | 28/284 |
| 4,501,046 | A | | 2/1985 | Krenzer | 19/35 |
| 4,505,013 | A | * | 3/1985 | Nelson | 28/274 |
| 4,674,273 | A | * | 6/1987 | Clements et al. | 57/287 |
| 4,825,517 | A | * | 5/1989 | Hagler | 28/220 |
| 4,852,226 | A | | 8/1989 | Goineau | 28/220 |
| 4,860,412 | A | | 8/1989 | Goineau | 28/219 |
| 4,864,701 | A | | 9/1989 | Goineau | 28/220 |
| 4,959,895 | A | | 10/1990 | Sager | 28/282 |
| 4,972,563 | A | | 11/1990 | Wheeler | 28/220 |
| 5,379,501 | A | * | 1/1995 | Goineau | 28/281 |
| 6,012,206 | A | | 1/2000 | Goineau | 28/220 |
| 6,055,712 | A | * | 5/2000 | Thoma | 28/220 |
| 6,105,224 | A | * | 8/2000 | O'Mara, Jr. et al. | 28/271 |
| 6,240,609 | B1 | * | 6/2001 | Rasnick, Jr. et al. | 28/258 |

* cited by examiner

*Primary Examiner*—Amy B. Vanatta
(74) *Attorney, Agent, or Firm*—Terry T. Moyer; Sara M. Current

(57) ABSTRACT

A compact core and effect yarn producing texturing machine which employs a face plate on which the core and effect yarn godets are mounted in one area of the face plate and another pair of godets are mounted in another area of the space plate. A loop breaker is mounted on said face plate between the godets of the ones mounted in another area of the face plate to break the loops of yarn produced in an air jet mounted between the core and effect yarn godets and the other set of godets.

5 Claims, 2 Drawing Sheets

FACE PLATE FOR SPUN-LIKE TEXTURED YARN

This invention relates to a yarn texturing machine which employs a face plate on which the core and effect yarn handling apparatus is mounted to produce a synthetic yarn with a spun-like appearance.

It is an object of this invention to provide a yarn handling arrangement on the face plate of a texturing machine which draws and combines core and effect yarn prior to supplying same to a loop breaking device also mounted on the face plate of the texturing machine.

Figure 1:
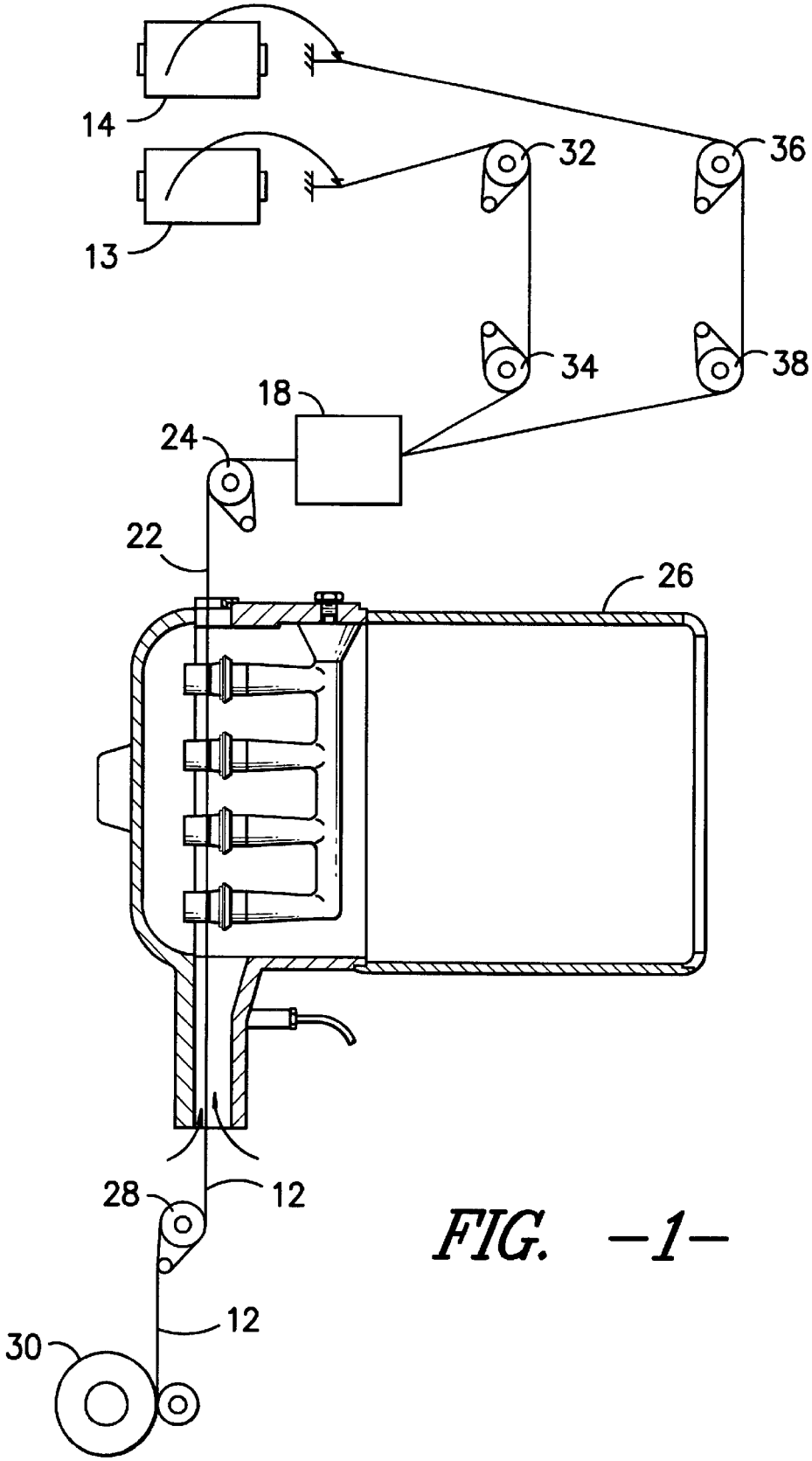
Figure 2:
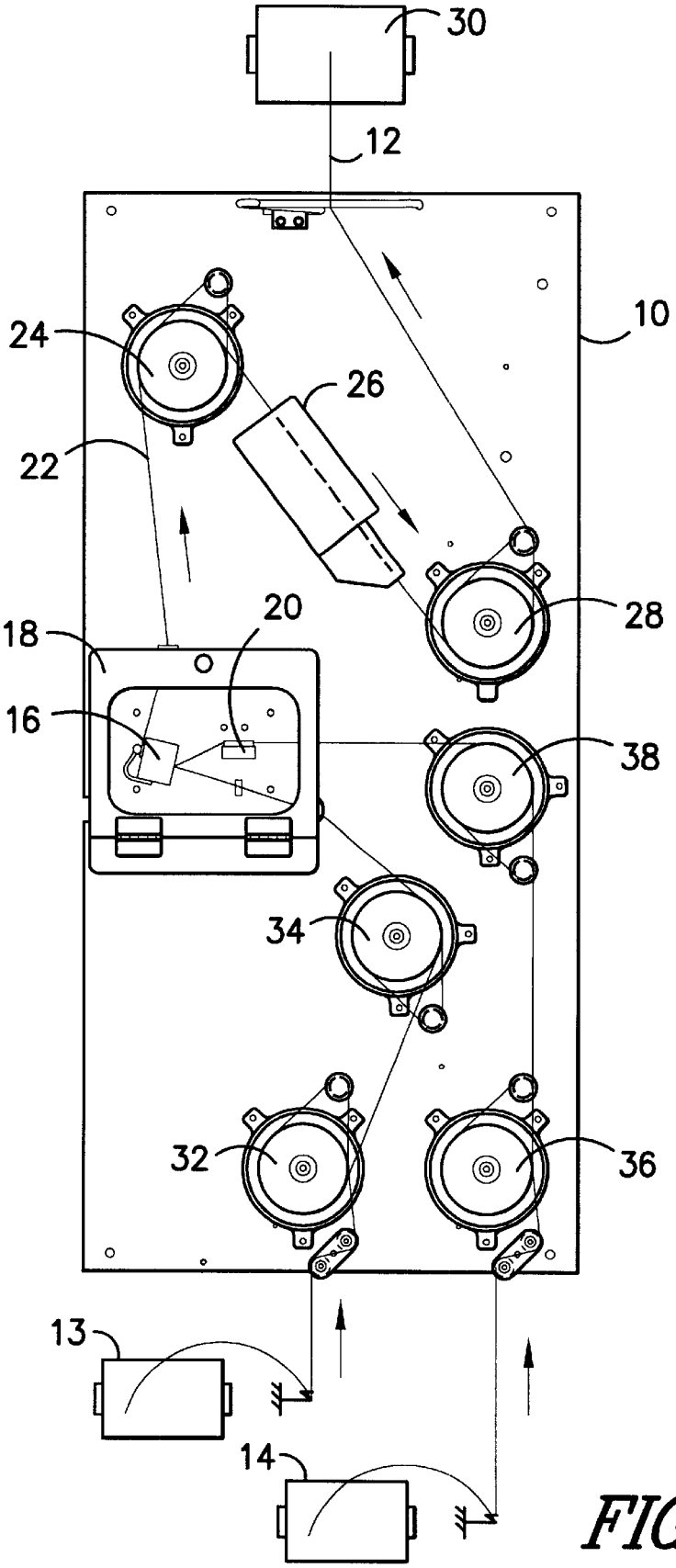

Other objects and advantages of the invention will become readily apparent as the specification proceeds to describe the invention with reference to the accompanying drawings, in which:

FIG. 1 is a schematic drawing of the process to manufacture a spun-like synthetic yarn; and FIG. 2 is a front view of the face plate of a yarn-texturing machine illustrating the position of the yarn handling components.

Looking now to the drawings, the overall system is shown mounted on a face place 10 to produce a spun-like synthetic yarn 12. The starting yarns are, preferably, 255/68 continuous filament polyester yarns from packages 13 and 14 which are merged in a suitable air jet 16 mounted in a jet box 18 in which is located a moisture applicator 20 to wet the core yarn from the yarn package 14. The merged and textured core and effect yarn 22 is drawn from the jet box 18 by the godet 24 driven at a speed of 550 meters/minute and delivered through the filament loop breaker 26 to the godet 28 driven at a speed of 578 meters/minute. From the godet 28 the spun-like synthetic yarn 12 is delivered to the take-up roll or bobbin 38.

Prior to the supply of the core and effect yarns to the jet box 18 from the packages 13 and 14, respectively, the yams therefrom are drawn between the heated driven godets. The effect yarn passes over and is drawn between the heated godets 32 and 34 which are heated respectively to temperatures of 90° C. and 170° C. to allow the yarn therebetween to be driven since the godet 32 being driven at a speed of 420 meters a minute and the godet is being driven at a speed of 693 meters/minute. Similarly the core yarn from the supply package 14 is drawn between driven godets 36 and 38 heated, respectively, to a temperature of 90° F. to 170° while being driven at a speed of 363 meters/minute and 599 meters/minute. It should be noted that the godets 36 and 38 are rotatably mounted on the face place to direct the core yarn into the side of the jet box 18 to prevent the water from the yarn moisturing device 20 from dripping down onto the godets and the incoming yarn.

The loop breaker for the loops of the textured yarn 22 is mounted on the face plate 10 as shown in FIG. 2 and, basically, is the loop breaker shown and disclosed in U.S. Pat. No. 6,012,206. As described briefly before, the loop breaker 26 tends to break the loops of the textured yarn formed in the jet box 18 to provide the textured spun-like synthetic yam 12 delivered to the take-up 30. This yarn 10 in the preferred form of the invention is about 336 denier, 136 filaments.

The herein disclosed variable speed driven component godet arrangement with the associated jet box 18 allows the loop breaker to be mounted on the face plate to provide ready access thereto for cleaning as well as ease of installation and to allow processing speed to be increased. Furthermore, the vertical arrangement of the godets 36 and 38 and especially 32 and 34 provides side access to the jet box so that the moisture from the yarn mounting does not leak or drip down on the machine components and yarn.

Although the preferred embodiment has been described specifically, it is contemplated that changes may be made without departing from the scope or spirit of the invention and it is desired that the invention be limited only by the scope of the claims.

What is claimed is:

1. A texturing machine to provide spun-like synthetic yarn comprising: an effect yarn supply, a core yarn supply, a take-up roll for processed yarn from said core and effect yarn supplies and a face plate, a core and effect texturing air-jet mounted on said face plate, a pair of spaced heated godets each mounted on said face plate and driven at different speeds receiving yarn from said core yarn supply to supply drawn core yarn to said texturing jet, a second pair of spaced heated godets mounted on said face plate and driven at different speeds to supply drawn effect yarn to said air jet; a third pair of godets mounted on said face plate and receiving textured, looped combined core and effect yarns from said air jet and a loop breaker mounted on said face place between the godets of said third pair of godets to break the loops of the core and effect yarn being supplied to said take-up roll.

2. The machine of claim 1 wherein said air jet is mounted in a jet box, said jet box having a yarn moistening apparatus therein to moisten the core yarn being supplied to said air jet.

3. The machine of claim 2 wherein the core yarn inlet to said jet box is in the side thereof to allow core yarn to be delivered into said jet box over said yarn moistening apparatus.

4. A face plate for a yarn texturing machine having a plurality of variable speed driven godets mounted therein, an air jet yarn texturing apparatus centrally located and mounted on said face plate, a first pair of heated driven godets located in the lower portion of said face plate, a second pair of heated driven godets located below said air jet yarn texturing apparatus, a third pair of spaced driven godets located on said face plate above said air jet texturing apparatus and a yarn loop breaker mounted on said face plate between the godets of said third pair to break the loops in a yarn passing from one of the third pair of godets to the other godet of said third pair of godets.

5. The face plate of claim 4 wherein the air jet texturing apparatus has an opening in the side thereof for the reception of yarns from said first and second pairs of godets.

* * * * *